US006960114B2

(12) United States Patent
Lee

(10) Patent No.: US 6,960,114 B2
(45) Date of Patent: Nov. 1, 2005

(54) PAD CONDITIONER OF CMP EQUIPMENT

(75) Inventor: Jong-Won Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/766,485

(22) Filed: Jan. 29, 2004

(65) Prior Publication Data

US 2004/0198200 A1 Oct. 7, 2004

(30) Foreign Application Priority Data

Feb. 12, 2003 (KR) ..... 10-2003-0008792

(51) Int. Cl.[7] ..... B24B 1/00
(52) U.S. Cl. ..... 451/5; 451/56; 451/72; 451/443
(58) Field of Search ..... 451/443, 5, 56, 451/41, 21, 72, 285, 288; 381/412; 310/20

(56) References Cited

U.S. PATENT DOCUMENTS 4,228,373 A * 10/1980 Funderburg ..... 310/20
5,607,341 A * 3/1997 Leach ..... 451/41
5,809,157 A * 9/1998 Grumazescu ..... 381/412
5,904,615 A * 5/1999 Jeong et al. ..... 451/443
5,951,368 A * 9/1999 Watanabe et al. ..... 451/5
6,036,583 A * 3/2000 Perlov et al. ..... 451/56
6,234,868 B1 * 5/2001 Easter et al. ..... 451/5
6,322,434 B1 * 11/2001 Satoh et al. ..... 451/443

FOREIGN PATENT DOCUMENTS

JP 2000-18620 4/2000

* cited by examiner

*Primary Examiner*—George Nguyen
(74) *Attorney, Agent, or Firm*—Volentine, Francos & Whitt, PLLC

(57) ABSTRACT

A pad conditioner of wafer planarization equipment includes a linear driving device for moving a disk holder up and down using a magnetic force. The linear driving device has an electromagnet, a permanent magnet, and a controller. The controller controls the power supplied to the electromagnet such that the electromagnet and permanent magnet produce a force of attraction and/or repulsion used to move the disk holder relative to a polishing pad of the wafer planarization equipment.

14 Claims, 4 Drawing Sheets

PAD CONDITIONER OF CMP EQUIPMENT

BACKGROUND OF THE INVENTION

1. Field of the Invention

The present invention relates to CMP equipment for planarizing a layer on a wafer during a process of manufacturing a semiconductor device. More specifically, the present invention relates to a pad conditioner of CMP equipment.

2. Description of the Related Art

Chemical mechanical polishing (CMP) is widely used to planarize the relatively large surfaces found on today's semiconductor wafers. The CMP process entails both chemically and mechanically removing material from the wafer. In the CMP process, a wafer having a step difference at the surface thereof is closely attached to a polishing pad. Slurry containing an abrasive agent and chemicals is dispensed onto the polishing pad between the stepped surface of the wafer and the pad to planarize the surface.

In this regard, the CMP equipment includes a pad conditioner for preventing the polishing pad from becoming irregular. The pad conditioner conditions the polishing pad by urging a diamond-bearing disk against the pad using a diaphragm under air pressure. However, the diaphragm becomes worn out if used for a long period of time. Thus, the diaphragm must regularly exchanged under a course of preventive maintenance (PM).

SUMMARY OF THE INVENTION

An object of the present invention is to provide a pad conditioner of wafer planarizing equipment that can move disk holder up and down relative to the polishing pad of the equipment without the need for a diaphragm.

In order to achieve this object, the pad conditioner of the present invention provides a disk holder that supports a polishing disk, and a conditioner head to which said disk holder is mounted so as to be rotatable and linearly movable up and down, wherein the conditioner head has a linear driving device comprising a magnetic field generator operative to move the disk holder between an upper position and a lower position using a magnetic force.

The linear driving device includes a first magnet and a second magnet. The first magnet is connected to the disk holder, and the second magnetic is connected to the conditioner head opposite the first magnet. Accordingly, the disk holder can be moved relative to the conditioner head by a magnetic force between the first and second magnets.

One of the first and second magnets is an electromagnet. An electric power source is connected to the electromagnet. The polarity of the electromagnet can be changed by the power source so forces of repulsion and attraction can be created between the first and second magnets.

A sleeve fixed to the disk holder extends into the housing of the conditioner head. The sleeve has a central longitudinal axis coincident with the axis of rotation of the disk holder. The first magnet is fixed to the sleeve. The second magnet may be installed in the housing of the conditioner head over the sleeve. Alternatively, the first magnet is fixed to a top surface of the disk holder, and the second magnet is fixed to a bottom surface of the housing.

DETAILED DESCRIPTION OF THE PREFERRED EMBODIMENTS

The present invention will now be described more fully hereinafter with reference to the accompanying drawings, in which like numbers refer to like elements throughout.

Figure 1:
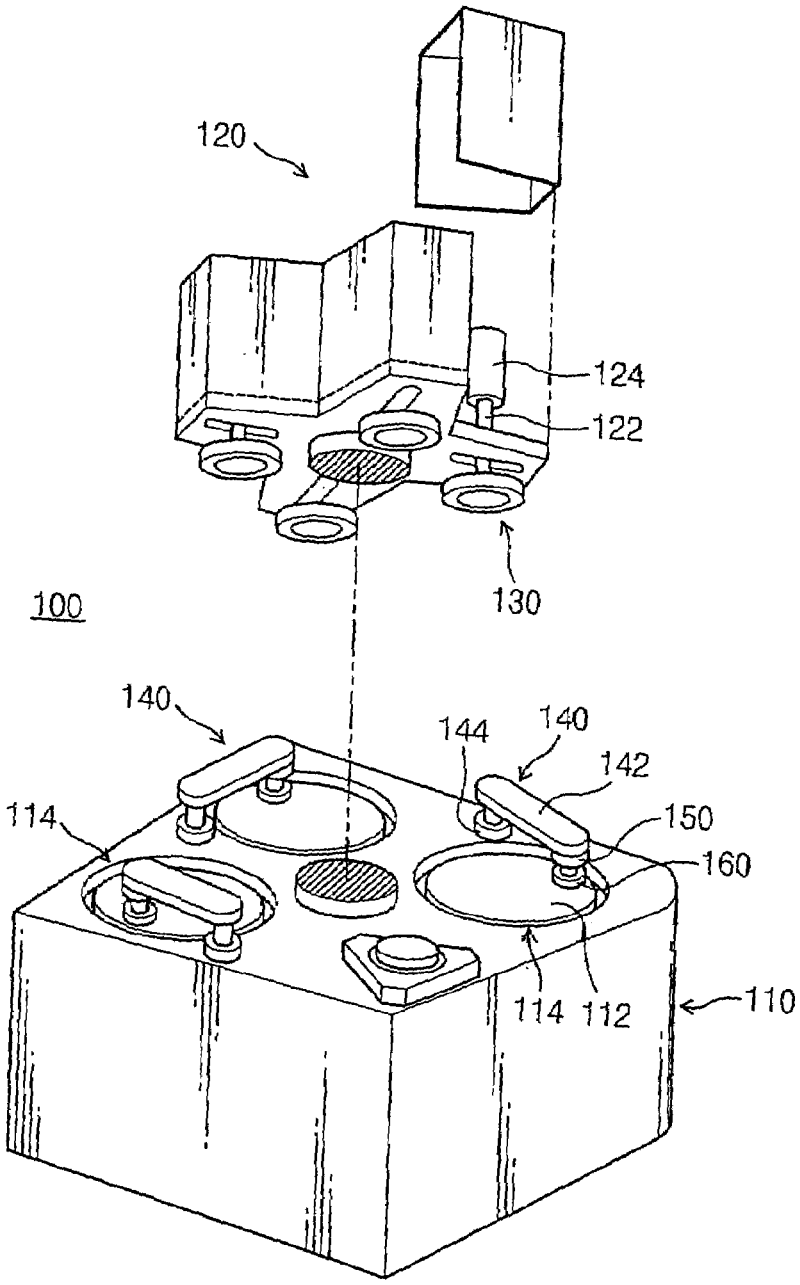
FIG. 1 is a perspective view of CMP equipment having a pad conditioner according to the present invention.

Referring to FIG. 1, CMP equipment 100 comprises a polishing station 110 and a polishing head assembly 120.

The polishing head assembly 120 includes a polishing head 130, a driving shaft 122, and a motor 124. The polishing head 130 holds a wafer against the polishing pad 112 and supplies a constant pressure to a rear side of the wafer. The polishing head 130 is rotated at a predetermined rate (revolutions per minute) by means of the driving shaft 122 coupled to motor 124. At least two fluid supply channels may be connected to the polishing head 130 for use in supplying air pressure for urging the head against the wafer and a vacuum by which a wafer is adhered to the head. Naturally, pumps are connected to these fluid supply channels, respectively.

The polishing station 110 includes a rotatable table 114 for supporting the polishing pad and a pad conditioner 140. The table 114 and the pad conditioner 140 are mounted on a base of the polishing station 110. The pad conditioner 140 removes contaminants from the surface of the polishing pad 112 and maintains a certain surface texture of the pad 112 as the polishing pad 112 polishes a substrate held by the polishing head 130 against the pad 112. That is, the pad conditioner 140 regulates the state of the surface of the polishing pad 112.

The pad conditioner 140 includes a conditioner head 150, a disk holder 160 holding a conditioner disk (not shown) having diamonds embedded therein, an arm 142, and a base 144. The conditioner head 150 is reciprocated across the polishing pad 112 to clean the polishing pad 130. The reciprocation of the conditioner head is synchronized with the movement of the polishing pad 130.

Figure 2:
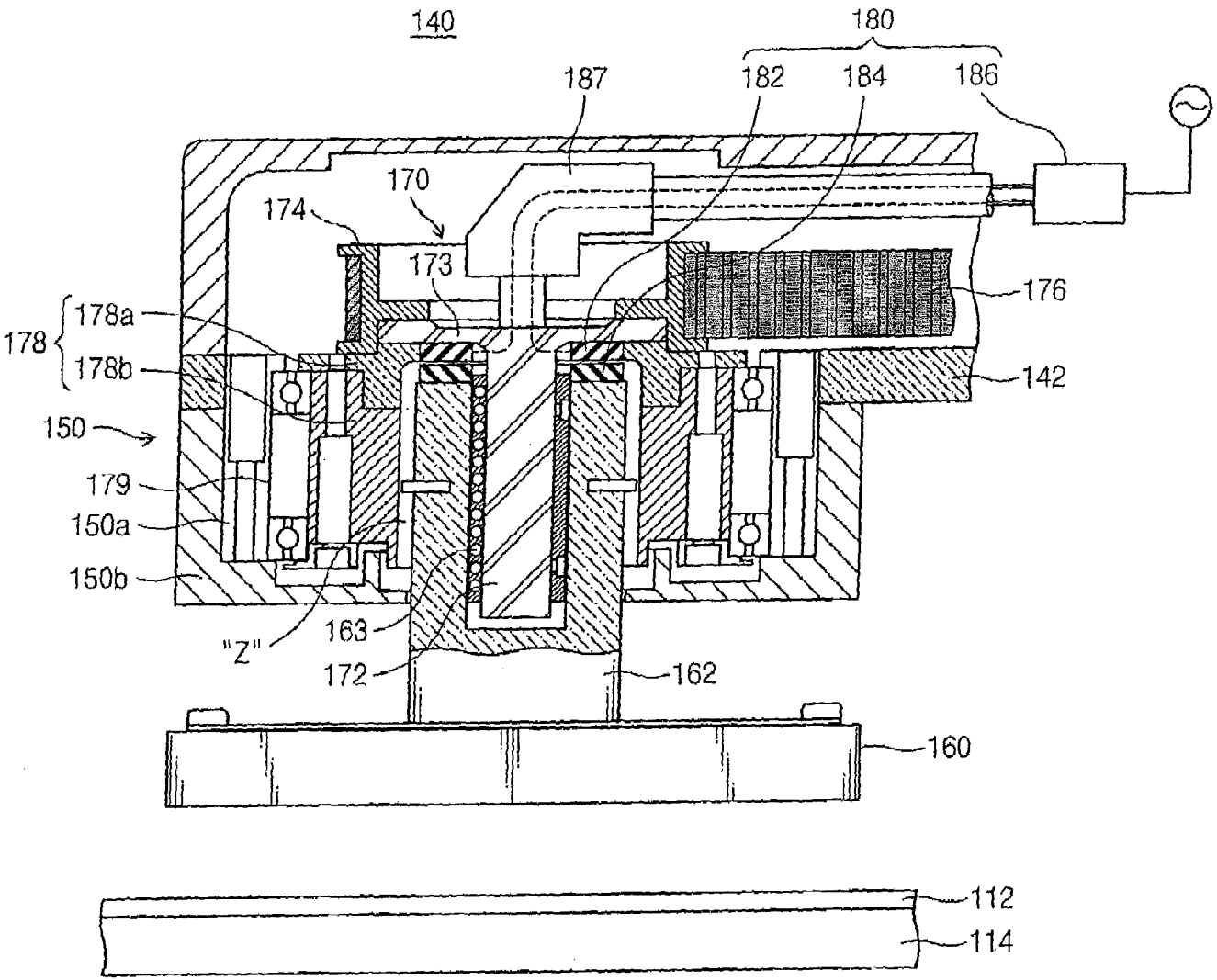
FIG. 2 and FIG. 3 are cross-sectional views of a pad conditioner according to the present invention.
Figure 3:
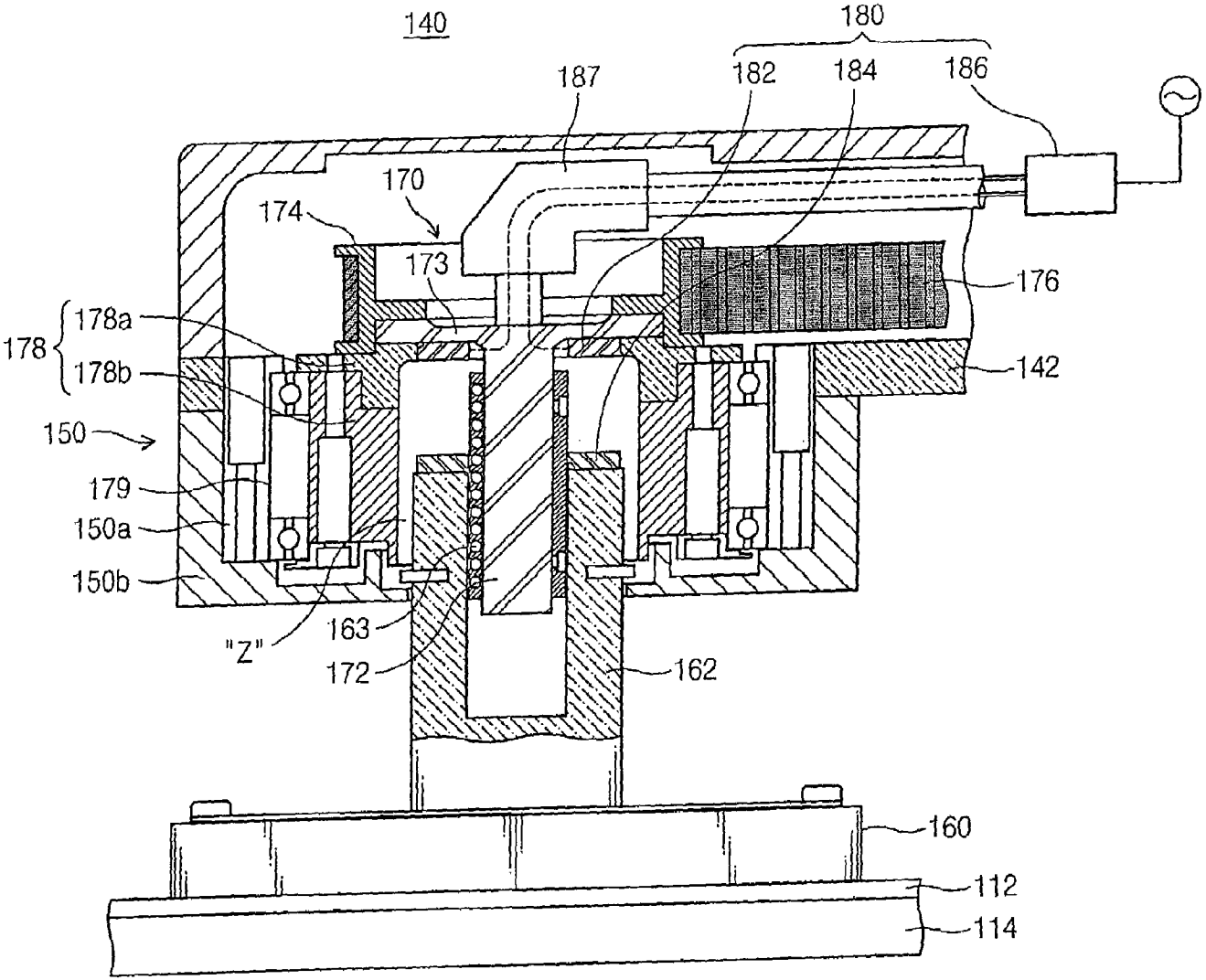

Referring to FIGS. 2 and 3, the conditioner head 150 includes a rotary driving device for rotating the disk holder 160 and a linear driving device 170 for moving the disk holder 160 up and down. The linear driving device 170 is operative to move the disk holder vertically between an upper position (see FIG. 2) and a lower position (see FIG. 3). The bottom of the disk holder 160 may be in contact with the polishing pad when the disk holder 160 is at its lower position.

The rotary driving device 170 will now be described in more detail. The rotary driving device 170 includes a driving shaft 172 having a flange 173 disposed at an upper end thereof. The driving shaft 172 extends vertically, whereas the flange 173 extends radially from the shaft 172. A pulley 174 is fixed to the flange 173. A drive belt 176 extends over the length of the arm 142 around the pulley 174. The belt 176 is coupled to a motor (not shown) for rotating the driving shaft 172 about its central longitudinal axis. A collar 178 having an upper piece 178*a* and a lower piece 178*b* surrounds the shaft 172, as extending co-axially therewith. The collar 178 is spaced radially from the driving shaft 172 such that an annular space "Z" is defined between the collar 178 and the shaft 172.

The driving shaft 172, pulley 174, and collar 178 are rotatably supported in the conditioner head 150 by a bearing unit 179 including upper and lower ball bearings. The bearing unit 179 connects the lower piece 178*b* of the collar 178 to an inner head housing 150*a* fixed to one end of the arm 142. The inner head housing 150*a* is maintained in a cup-shaped outer head housing 150*b* fixed to the arm 142.

The disk holder 160 is connected to the driving shaft 172 by a ring-shaped driving sleeve 162 that is mounted in the annular space "Z" between the collar 178 and the driving shaft 172. The driving sleeve 162 is keyed to the driving shaft 172 so as to prevent relative rotation between the driving sleeve 162 and the driving shaft 172, and yet allow the driving sleeve 162 to move relative to the driving shaft 172 along the length thereof. The driving shaft 172 transmits torque from the pulley 174 to the driving sleeve 162. A linear bearing 163 is interposed between the driving shaft 172 and the driving sleeve 162 to allow the driving sleeve 162 to slide smoothly along the driving shaft 172.

The linear driving device 180 moves the disk holder 160 up and down using a magnetic force. The driving device 180 includes an electromagnet 182 for generating an induction field using electric current, a permanent magnet 184, and a controller 186 for controlling the power supplied to the electromagnet 184. Reference number 187 designates wire for supplying power to the electromagnet 184. The amount of current supplied to the electromagnet 182 can be varied by the controller 186 to change the strength of the magnetic field induced by the electromagnetic 184. Also, the polarity of the electromagnet 182 can be changed by the controller 186 to create a force of repulsion or attraction between the electromagnet 182 and the permanent magnet 184.

As shown in the FIG. 2, the electromagnet 182 and the permanent magnet 184 are disposed opposite one another with the permanent magnet 184 installed on the sleeve 162 of the disk holder 160, and the electromagnet 182 installed on the bottom side of the flange 173 integrated with the driving shaft 172. Accordingly, a force of repulsion is created between the driving sleeve 162 and the flange 173 when the electromagnet 182 is provided with same polarity as the pole of the permanent magnet 184 that confronts the electromagnet 182. In this case, the driving sleeve 162 is forced down to lower the disk holder 160 towards the polishing pad 112 (FIG. 3). The force by which the disk holder 160 is pressed against the polishing pad 112 is regulated by the controller 186, i.e., by controlling the amount of power applied to the electromagnet 182. One the other hand, a force of attraction is created between the driving sleeve 162 and the flange 173 when the electromagnet 182 is magnetized to a polarity that is different from that of the magnetic pole of the permanent magnet 184 that faces the electromagnet 182. In this case, the driving sleeve 162 is forced upwardly to raise the disk holder 160 (FIG. 2).

Figure 4:
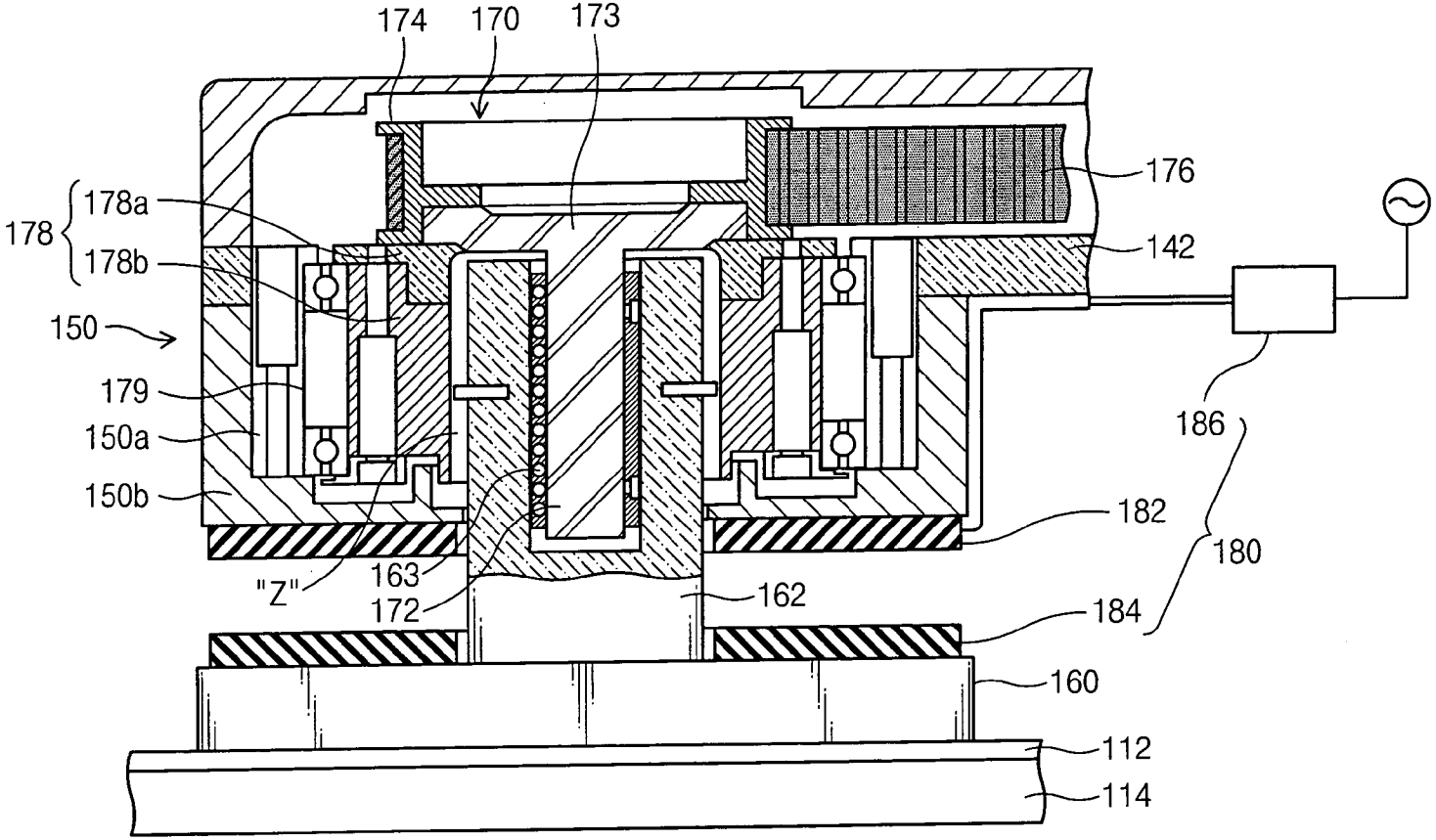
FIG. 4 is a cross-sectional view of another pad conditioner according to the present invention, showing an alternative installation of a permanent magnet and electromagnet in the conditioner head of the pad conditioner.

FIG. 4 illustrates an alternative installation of the permanent magnet and an electromagnet of the pad conditioner according to the present invention.

In this embodiment, the electromagnet 182 and the permanent magnet 184 are installed on the bottom of the outer head housing 150*b* of the conditioner head and on the top of the disk holder 160, respectively. This simplifies the internal structure of the conditioner head.

According to the present invention, the linear driving device for the disk holder operates using a magnetic force created by permanent parts instead of air pressure transferred by an expendable diaphragm. Therefore, the linear driving device of the pad conditioner of the present invention has a longer useful life than that of the conventional pad conditioner, i.e., requires less maintenance and expense.

Finally, although the present invention has been described in connection with the preferred embodiments thereof, other embodiments may be devised without departing from the true spirit and scope of the invention as defined by the appended claims.

What is claimed is:

1. A pad conditioner of planarization equipment for conditioning a surface of a polishing pad, comprising:

a disk holder that supports a polishing disk; and a conditioner head to which said disk holder is mounted so as to be rotatable and linearly movable up and down, said conditioner head having a rotary driving device operatively connected to said disk holder so as to rotate said disk holder about an axis of rotation, and linear driving device operative to move the disk holder between an upper position and a lower position, said linear driving device including a first magnet and a second magnet, said first magnet being connected to said disk holder, and said second magnetic being connected to said conditioner head opposite the first magnet, whereby the disk holder can be moved relative to the conditioner head by a magnetic force between the first and second magnets.

2. The pad conditioner as recited in claim 1, wherein one of said first and second magnets is an electromagnet, and further comprising a an electric power source connected to said electromagnet.

3. The pad conditioner as recited in claim 2, wherein said power source is operative to reverse the polarization of said electromagnet such that forces of repulsion and attraction can be created between the second and first magnets.

4. The conditioner as recited in claim 1, wherein said conditioner head includes a housing, and further comprising a sleeve fixed to said disk holder and extending therefrom into the housing of said conditioner head, said sleeve having a central longitudinal axis coincident with the axis of rotation of said disk holder, said first magnet being fixed to said sleeve.

5. The conditioner as recited in claim 1, wherein said first magnet is a permanent magnet and said second magnet is an electromagnet.

6. Chemical mechanical polishing equipment for use in polishing a substrate, said equipment comprising:

a polishing station including a polishing pad, a rotatable table supporting said polishing pad, and a pad conditioner for use in conditioning an upper surface of the polishing pad, said pad conditioner comprising a disk holder that supports a polishing disk, and a conditioner head includes a housing, said disk holder is mounted to said conditioner head so as to be rotatable and linearly movable up and down, said conditioner head having a rotary driving device operatively connected to said disk holder so as to rotate said disk holder about an axis of rotation, and linear driving device operative to move the disk holder between an upper position and a lower position, said linear driving device including a first magnet and a second magnet, said first magnet being fixed to a top surface of said disk holder, and said second magnetic being fixed to a bottom surface of said housing opposite the first magnet, whereby the disk holder can be moved relative to the conditioner head by a magnetic force between the first and second magnets; and a polishing head assembly disposed above said polishing station, said polishing head assembly including a polishing head that holds a substrate against the polishing pad.

the first magnet is fixed to a top surface of said disk holder, and the second magnet is fixed to a bottom surface of said housing.

7. The chemical mechanical polishing equipment as recited in claim 6, wherein one of said first and second magnets of the linear driving device of said pad conditioner is an electromagnet, and wherein said pad conditioner further comprises an electric power source connected to said electromagnet.

8. The chemical mechanical polishing equipment as recited in claim 7, wherein said power source is operative to reverse the polarization of said electromagnet such that forces of repulsion and attraction can be created between the second and first magnets.

9. The chemical mechanical polishing equipment as recited in claim 6, wherein said conditioner head includes a housing, and said pad conditioner further comprises a sleeve fixed to said disk holder and extending therefrom into the housing of said conditioner head, said sleeve having a central longitudinal axis coincident with the axis of rotation of said disk holder, and said first magnet being fixed to said sleeve.

10. A pad conditioner of planarization equipment for conditioning a surface of a polishing pad, comprising:

a disk holder that supports a polishing disk; and a conditioner head including a housing to which said disk holder is mounted so as to be rotatable and linearly movable up and down, said conditioner head having a rotary driving device operatively connected to said disk holder so as to rotate said disk holder about an axis of rotation, and linear driving device operative to move the disk holder between an upper position and a lower position, said linear driving device including a first magnet and a second magnet, said first magnet being fixed to a top surface of said disk holder, and said second magnetic being fixed to a bottom surface of said housing opposite the first magnet, whereby the disk holder can be moved relative to the conditioner head by a magnetic force between the first and second magnets.

11. The pad conditioner as recited in claim 10, wherein one of said first and second magnets is an electromagnet, and further comprising a an electric power source connected to said electromagnet.

12. The pad conditioner as recited in claim 11, wherein said power source is operative to reverse the polarization of said electromagnet such that forces of repulsion and attraction can be created between the second and first magnets.

13. The conditioner as recited in claim 10, wherein said conditioner head includes a housing, and further comprising a sleeve fixed to said disk holder and extending therefrom into the housing of said conditioner head, said sleeve having a central longitudinal axis coincident with the axis of rotation of said disk holder, said first magnet being fixed to said sleeve.

14. The conditioner as recited in claim 10, wherein said first magnet is a permanent magnet and said second magnet is an electromagnet.

* * * * *